US007158746B2

(12) United States Patent
Swift

(10) Patent No.: US 7,158,746 B2
(45) Date of Patent: Jan. 2, 2007

(54) XEROGRAPHIC PRINTER HAVING A SEMIRESISTIVE ROTATABLE BRUSH IN THE TRANSFER ZONE

(75) Inventor: Joseph A. Swift, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 71 days.

(21) Appl. No.: 10/853,831

(22) Filed: May 25, 2004

(65) Prior Publication Data

US 2005/0265756 A1 Dec. 1, 2005

(51) Int. Cl.
*G03G 15/16* (2006.01)

(52) U.S. Cl. ..... 399/313

(58) Field of Classification Search ..... None
See application file for complete search history.

(56) References Cited

U.S. PATENT DOCUMENTS 3,691,993 A 9/1972 Krause et al. ..... 118/637
3,781,105 A 12/1973 Meagher ..... 355/3
3,841,892 A * 10/1974 Krause et al. ..... 430/126
5,198,864 A 3/1993 Fletcher ..... 355/274
5,233,395 A * 8/1993 Kohyama ..... 399/314
5,737,670 A * 4/1998 Ikegawa ..... 399/149
5,943,526 A * 8/1999 Kodama ..... 399/66
6,167,229 A * 12/2000 Watanabe et al. ..... 399/313
6,256,461 B1 * 7/2001 Takeyama et al. ..... 399/66

FOREIGN PATENT DOCUMENTS

JP 62058282 A * 3/1987
JP 05323798 A * 12/1993

* cited by examiner

*Primary Examiner*—Quana Grainger
(74) *Attorney, Agent, or Firm*—R. Hutter

(57) ABSTRACT

An electrostatographic printing apparatus comprises a charge receptor, and a brush forming a nip against a portion of the charge receptor. The nip is suitable for passing a sheet therethrough. The brush comprises fibers, each fiber being semi-resistive.

7 Claims, 4 Drawing Sheets

XEROGRAPHIC PRINTER HAVING A SEMIRESISTIVE ROTATABLE BRUSH IN THE TRANSFER ZONE

TECHNICAL FIELD

The present disclosure relates to a transfer station used in electrostatographic or xerographic printing.

BACKGROUND

The basic process steps of electrostatographic printing, such as xerography or ionography, are well known. Typically an electrostatic latent image is created on a charge receptor, which in a typical analog copier or "laser printer" is known as a photoreceptor. The suitably charged areas on the surface of the photoreceptor are developed with fine toner particles, creating an image with the toner particles which is transferred to a print sheet, which is typically a sheet of paper but which could conceivably be any kind of substrate, including an intermediate transfer belt. This transfer is typically carried out by the creation of a "transfer zone" of AC and DC biases where the print sheet is in contact with, or otherwise proximate to, the photoreceptor. Devices to create this transfer zone, such as corotrons, are well known.

Another condition which is known to be useful in a transfer zone is mechanical pressure between the print sheet and the photoreceptor: a certain amount of pressure can enhance transfer efficiency, image quality and "latitude" (the range of types of paper or other substrate which can be effectively printed on). To obtain such pressure, it is known to use a "bias transfer roll," which is an electrically-biased roll urged against either a rigid photoreceptor drum or a back up roll inside a photoreceptor belt. The combination of mechanical pressure and electrical bias creates a suitable transfer zone in the nip between the bias transfer roll and the photoreceptor.

The present disclosure relates to a novel apparatus for creating suitable conditions in a transfer zone.

PRIOR ART

U.S. Pat. No. 3,691,993 shows a xerographic transfer system where a rotating cylindrical brush is used. The patent teaches the use of metallic conductivity fibers via metallic fibers or metallic coatings on a non-conductive fiber core.

U.S. Pat. No. 3,781,105 shows a xerographic transfer system where a bias transfer roll is deformable against a roller inside a photoreceptor belt.

U.S. Pat. No. 5,198,864 shows a xerographic transfer system with field tailoring wherein constant current and pre-transfer and post-transfer zone transfer field features are described.

SUMMARY

According to one aspect, there is provided an electrostatographic printing apparatus, comprising a charge receptor, and a brush forming a nip against a portion of the charge receptor. The nip is suitable for passing a sheet therethrough. The brush comprises fibers, each fiber being semi-resistive.

According to another aspect, there is provided an electrostatographic printing apparatus, comprising a first charge receptor, and a rotatable intermediate transfer member receiving marking material from the first charge receptor at a first transfer point. The rotatable intermediate transfer member transferring marking material to a print sheet at a final transfer point. At least one of the first transfer point and the final transfer point has associated therewith a brush in contact with the rotatable intermediate transfer member. The brush includes fibers, each fiber being semi-resistive.

DETAILED DESCRIPTION

Figure 1:
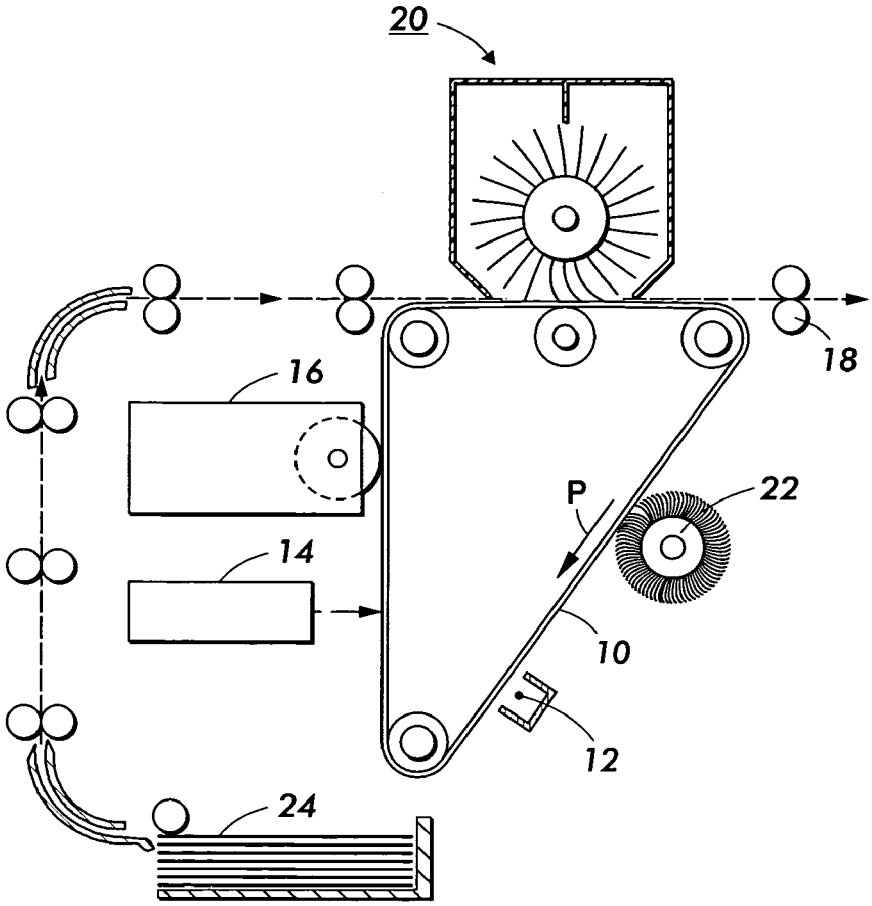
FIG. 1 is a simplified elevational diagram showing some essential elements of an electrostatographic printing apparatus, such as a printer or copier.

FIG. 1 is a simplified elevational diagram showing some essential elements of an electrostatographic printing apparatus, such as a printer or copier. As is familiar in electrostatographic printing, in particular ionography or xerography, electrostatic latent images are created on the surface of a charge receptor, such as the photoreceptor indicated as 10. As is generally familiar in xerography, there is further included a charge corotron 12 for initially uniformly charging the surface of photoreceptor 10; an exposure device 14, such as including a laser or an LED printbar, for discharging portions of the surface of photoreceptor 10 to yield a desired electrostatic latent image; a development unit 16, for causing toner particles to attach to suitably charged image areas on the surface of photoreceptor 10; and a transfer station 20, as will be discussed below. Downstream of transfer station 20 is a fusing apparatus 18 for fixing toner particles onto a print sheet to yield a permanent image. Any toner particles remaining on the print sheet after transfer are removed by cleaning station 22.

The sheets on which images are desired to be printed are drawn from a stack 24 and brought into a "transfer zone" which, depending on a particular design of the apparatus, typically involves contact or proximity of the sheet with the surface of the photoreceptor 10, as well as suitable electric fields. The transfer station 20 includes apparatus for creating suitable conditions for the transfer zone.

Figure 2:
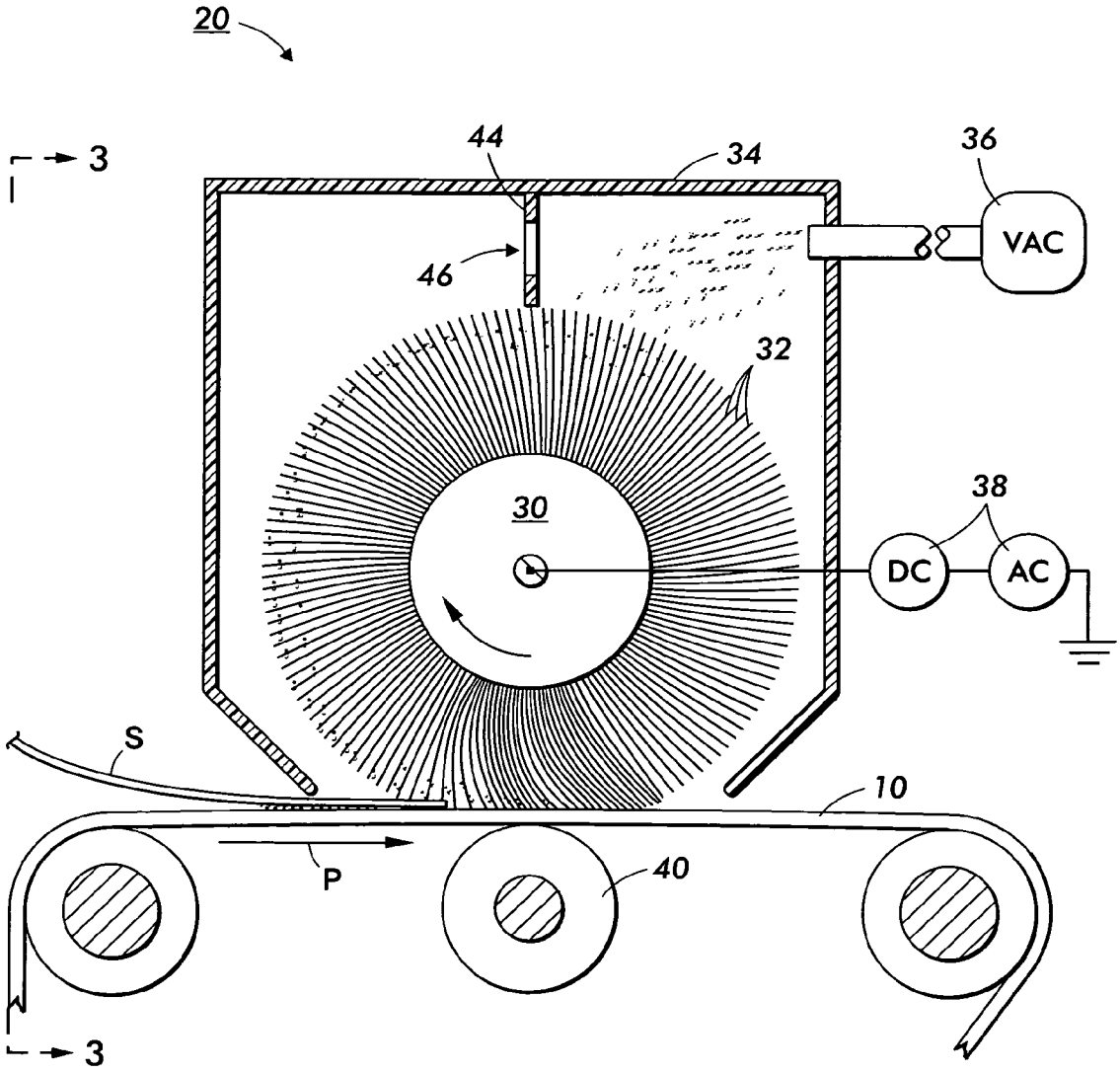
FIG. 2 is a detailed elevational view of a transfer station.

FIG. 2 is an elevational view showing transfer station 20 in detail. There is provided a cylindrical brush 30, having around the circumference thereof fibers 32, which will be described in detail below. The fibers 32 which are not in contact with photoreceptor 10 at a given time are surrounded by a manifold 34, which is in communication with a vacuum source 36. The vacuum source 36 may be associated with other vacuum sources within the machine, such as for paper feeding and direct cleaning of the photoreceptor 10 such as by cleaning station 22. Further, the cylindrical brush 30 is biased by either or both DC or AC sources 38.

In operation, a longitudinal portion of cylindrical brush 30 is in contact with the photoreceptor 10, extending across the photoreceptor 10 along a direction perpendicular to a direction of motion (process direction P) of photoreceptor 10. When a sheet S, intended to have a toner image transferred thereto, is inserted in a nip between brush 30 and photoreceptor 10, the fibers 32 of brush 30 contribute to urging the sheet S against photoreceptor 10 and substantially eliminate large air gaps therebetween. If photoreceptor 10 is in the form of a flexible belt, a reasonably hard backing roll 40 is disposed inside the photoreceptor 10 opposite the brush 30; if a rigid drum-type photoreceptor is used, such a backing roll is not necessary.

As seen by the arrow associated with cylindrical brush 30, the brush 30 is generally caused to rotate in a direction against the rotational direction of photoreceptor 10. The rotation can be caused by any known means familiar in the design of office equipment, such as an electric motor (not shown). In a practical application, the rotational speed for the brush 30 is selected with consideration to allowing a sufficient "dwell time" within the manifold 34, to allow vacuum source 36 to draw a vacuum around a portion of the brush 30 and thereby remove dirt from the fibers 32, as shown. Other devices for cleaning the fibers 32, such as a flicker bar (not shown) or detoning roll or detoning belt (not shown), may be provided within manifold 34. Alternately, the manifold may be additionally configured into a long, narrow slit to contact a smaller sector of the brush circumference along its length in order to save space or to enable a high velocity airflow to provide greater removal force to effectively separate toner, dirt, and other contaminants from the fibers.

The manifold 34 may be configured to have more than one internal baffle whereby airflow volumes and velocities can be tuned to serve not only to remove contaminants from the brush but also to assist in separation of the print sheets from the photoreceptor at the nip exit of the transfer station. One example of such a baffle is shown as 44, although the specific design of the baffle will depend highly on a particular implementation. The baffle 44, which may include openings such as 46, can be used to set up within the manifold 34 a number of distinct portions, each portion being characterized by a particular airflow volume or velocity to obtain an effective cleaning of the brush 30.

A duty cycle governing rotation of the brush 30 can be adjusted during the overall process intervals when the brush is not being used for the transfer operation. By controlling the rotation, the brush 30 can be additionally employed to clean the surface of the photoreceptor 10 when and where sheets are not present in the nip. In this instance, the bias as well as the rotation direction and velocity can be rapidly changed to accommodate the additional cleaning operation. Although the present embodiment shows the direction of brush rotation with respect to the photoreceptor, variable brush direction and speed may be employed, for example to cause the brush 30 to be stationary or nearly stationary while the brush is in contact with the sheet but accelerate or reverse direction as the trailing edge of the sheet exits the nip. Variable speed and direction can thereby assist with dynamic sheet detacking from the photoreceptor and improve brush detoning.

Although the brush 30 is shown as a cylindrical brush in the embodiment, the brush 30 can be of any rotatable structure, such as a belt entrained on two or more rollers.

Figure 3:
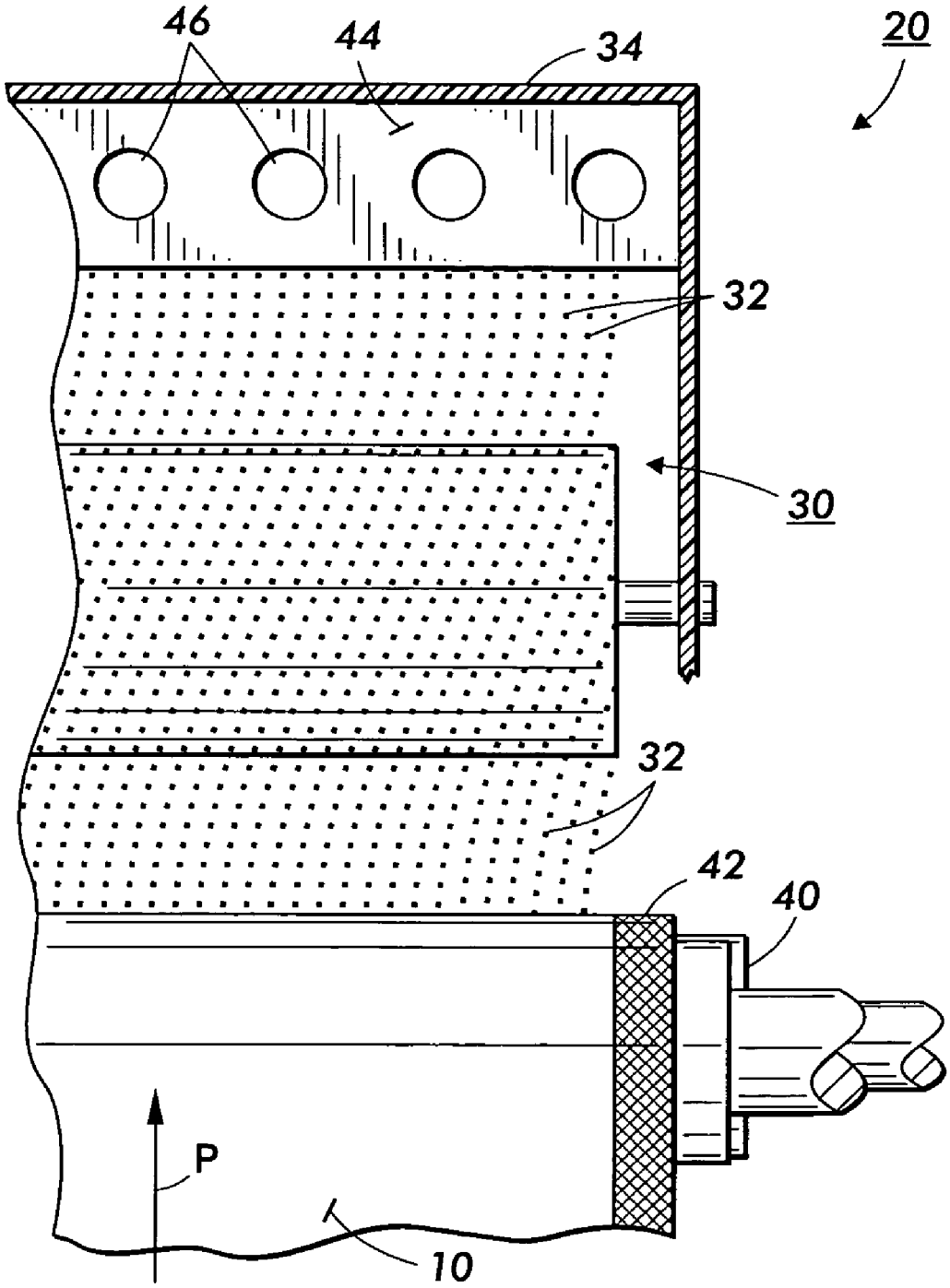
FIG. 3 is a detailed elevational view of the transfer station, from a direction shown as 3 in FIG. 2.

FIG. 3 is a detailed elevational view of a portion of the transfer station 20, from a direction shown as 3 in FIG. 2. As can be seen in the Figure, the brush 30, as mounted within manifold 34, does not extend the entire crosswise width of photoreceptor 10; rather, the brush 30 is mounted to largely avoid any contact by the fibers 32 with a "ground plane" 42 disposed along one edge of photoreceptor 10. The ground plane 42 is a largely conductive area of the photoreceptor, and is typically connected to ground (by means not shown) as used for various purposes in a practical xerographic printing apparatus. In the case of a drum type photoreceptor, the metal core of the drum may serve as the ground plane.

The fibers 32 of the brush are soft with respect to the photoreceptor and do not produce high mechanical stress or loads on the photoreceptor nor print copy. Thus, there is no mechanical wear of the photoreceptor or transfer sheet nor does any image motion quality disturbance occur to the printing process. The soft fibers are flexible and thereby can conform to misalignments of the paper and photoreceptor and enable high quality transfer to occur in the presence of surfaces that are not perfectly parallel.

In a conventional transfer station, transfer of toner is achieved by applying electrostatic force fields in the transfer zone sufficient to overcome forces which hold the toner particles to the surface of the photoreceptor. These electrostatic force fields operate to attract and move the toner particles onto the second supporting surface, which may be either a print sheet or an intermediate transfer belt. The problems associated with successful toner transfer are well known and relate to careful control of the electrostatic field forces not only within the transfer nip but also for a short distance before and after the transfer nip. The mechanical transfer nip is defined as the region wherein mutual mechanical contact occurs in the presence of the electrostatic transfer field amongst the toner and photoreceptor, toner and print sheet, and, print sheet and biased transfer member. With regard to the electrical bias on the brush 30, provided by an electric biasing source including DC and AC sources 38, the electrically conductive substrate 42 of belt 10 is connected to ground thereby creating an electric potential difference between the brush and belt. The net polarity applied to the brush 30 is generally opposite to the charge of the toner particles and current flows between the brush and the photoreceptor and between the brush and sheet in a manner that is governed by the total circuit resistance, which in a practical application is limited by the fiber resistance.

Since the influence of the electrostatic transfer field upon the toner particles can extend beyond the mechanical transfer nip, the effect of the pre-and post-transfer nip regions that define the photoreceptor-to-sheet edges (namely, vertical steps) perpendicular to the process direction in addition to the sheet edge regions that define the photoreceptor-to-sheet edges parallel to the process direction must be considered in order to assure reliable toner transfer without toner spatial disturbances that can affect print quality. It is important to note that the sheet S increases the spacing between the fiber tips and the ground plane thereby serving to reduce the electrostatic field in this region where the brush is in contact with the sheet and spaced further away from the photoreceptor and ground plane. In order to minimize any print defects at these edges, constant current density is the objective.

In a practical application a constant current between the brush 30 and photoreceptor 10 and between the brush 30 and sheet S (wherein the current density is defined as the current flow per unit area of contact region) is held constant throughout the various regions of contact and particularly at the sheet edges. This minimizes problems with non-uniform edge fields and end-leakage that can occur at the edge regions of the sheet resulting in poor image quality and edge deletions. In contrast, the '993 patent cited above teaches that a constant voltage is desirable.

The fibers 32 are "semi-resistive," meaning each fiber has a functional resistance (or, for each fiber, a resistance per unit length) in a range that is between "conductive" and "insulating." Two boundaries govern the operational range of fiber resistance per length. The first boundary, i.e. the lower boundary limit, relates to the impacts of electric shorting of the entire brush when one or more single fibers incidentally come into contact with a ground plane 42 such at one edge of the photoreceptor 10, and thereby serves to limit the maximum current that can flow between the brush and photoreceptor. The second or upper limit boundary is related to what dynamic voltage exists at the fiber tips and thereby the level of the transfer field which is present in the transfer nip to carry out the electrostatic transfer function. In between these boundaries, the resistance of the fiber is acceptable to perform the intended transfer functions.

Generally the resistance of the fiber along its length behaves accordingly to Ohm's law wherein there is a relationship between the fiber resistance per length, the current passing through the fiber, and the field (voltage) established at the fiber tip. In general, fibers that exhibit either "ohmic behavior," wherein the resistance value is independent of the applied voltage, or exhibit "nonohmic behavior," wherein the fiber resistance depends upon the applied voltage, can be used productively.

With regard to the first boundary of the operational range, the fibers 32 of the transfer brush must be sufficiently resistive to limit local current flow so that, in the case of incidental, direct contact with ground experiencing the direct short condition (such as contact with ground plane 42), a small amount of current flows to ground. However, in such a ground condition, the grounded fibers are resistively isolated from the rest of the brush structure so that the rest of the brush can participate in the transfer operation in the presence of a conditional electric short. In a practical application, the minimum fiber resistance must be between about 100 and 10,000 ohms/cm to achieve this behavior. This range of fiber resistance can also serve to protect the power source from damage of a direct short or alternatively can prevent incidental power shut downs, i.e. tripping to an off condition during an incidental short between a fiber and ground.

With regard to the second boundary of the operational range, the fiber resistance must be low enough to enable the applied voltage on the brush core to conduct ("relax") along the fiber's length and develop a surface potential at the contacting end of the brush in the nip region within the duration of the nip cycle time. This produces a potential difference at the back of the print copy within the transfer zone to effect field-driven electrostatic transfer. For this condition, every fiber of the brush can be modeled as an electric circuit consisting of a resistor in parallel with a capacitor with an applied voltage at one leg and the paper in the nip as a load resistor in series with the photoreceptor and ground plane. For the second boundary condition at typical transfer process speeds, the fiber resistance is in the range of about $10^{10}$ to $10^{13}$ ohms/cm wherein sufficient charge (or current) can flow along the length of the fiber to create the desired transfer conditions within the transfer zone.

To obtain the above-described properties, a suitable construction of the fibers 32 employs an easy to clean, semi-resistive, non-metallic, polymeric fiber, either by use of controlled conductivity composite fibers or similar composite coatings on or within suitable substrate core fiber. Alternatively, semi-resistive carbon fibers can be used that can be made by controlled heat treatment processing of polyacrylonitrile (PAN) or other heat convertible polymeric fibers that are known in the art. The semi-resistive nature of the fibers 32 yields desirable electrical fields in the transfer zone, and further allow dirt and stray toner particles to be removed from the fibers within manifold 34 largely by the force of vacuum 36. In contrast, the '993 patent cited above teaches the use of fibers of essentially metallic conductivity ranges, either metallic fibers or metallic coatings on a non-conductive fiber core.

Furthermore, the resistance of the fiber as measured in the radial direction can be gradually or stepwise increased such that the resistance of the periphery of the fiber is significantly higher than the rest of the cross section. This configuration minimizes current flow between adjacent contacting fibers and thereby helps to assure the constant current density conditions described above.

Figure 4:
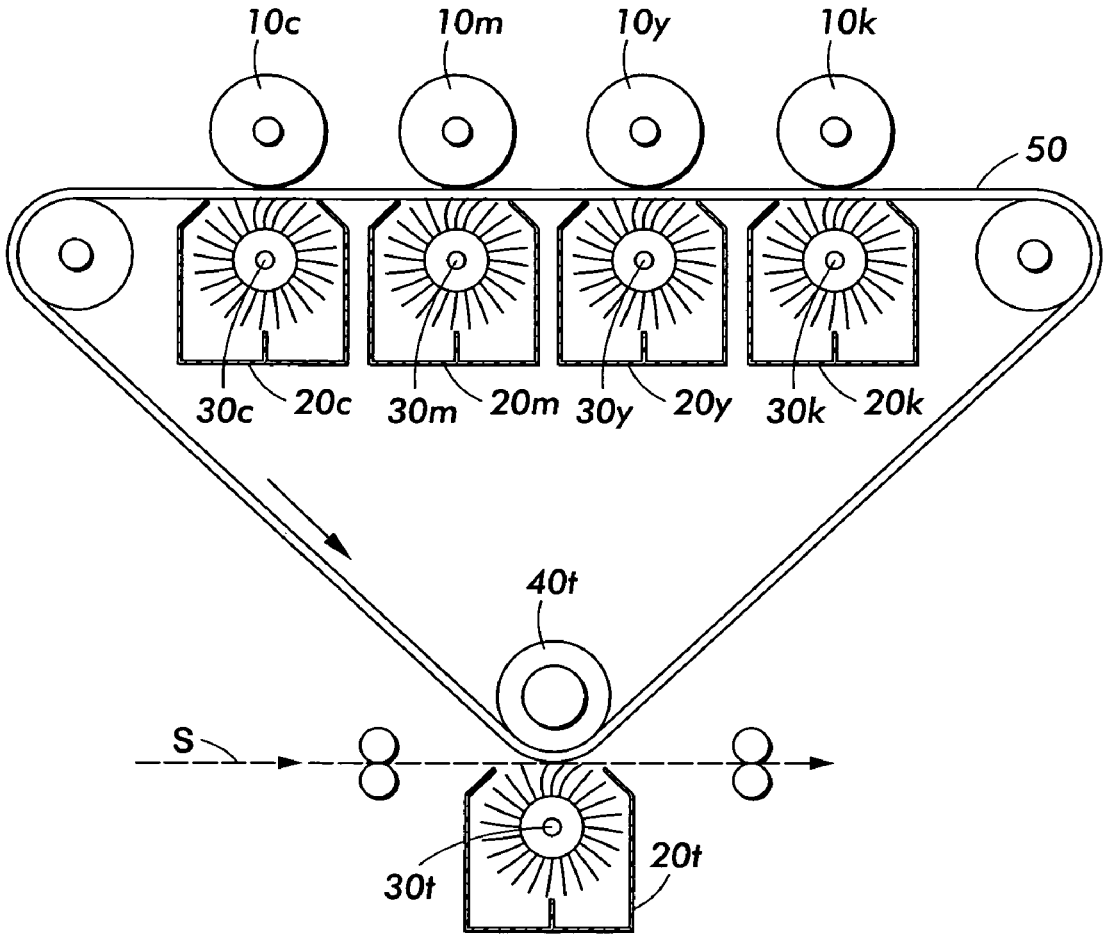
FIG. 4 is a simplified elevational view of elements of a full-color xerographic engine.

Although the present embodiment shows a charge receptor in the form of a photoreceptor in a simple monochrome xerographic printer, the charge receptor can alternatively be a blanket roll or belt, such as used in sophisticated image transfer systems, or an intermediate roll or belt, such as used in color xerography to accumulate toner layers associated with multiple color separations. FIG. 4 is a simplified elevational view of elements of a full-color xerographic engine, using multiple photoreceptors arranged around a flexible intermediate transfer belt, a basic architecture familiar in the art. In this case, four drum photoreceptors, indicated as 10*c*, 10*m*, 10*y*, and 10*k* (the letters corresponding to the colors-cyan, magenta, yellow, and black-supplied by each photoreceptor) are arranged to contribute toner separations to a rotatable intermediate transfer belt 50. For each photoreceptor, on an opposite side (i.e., inside surface) of the intermediate transfer belt 50, there is provided a cylindrical brush, such as 30*c*, 30*m*, 30*y*, 30*k*, assisting in transferring toner from the photoreceptor to the outside surface of intermediate transfer belt 50. Each general location where a brush contacts the intermediate transfer belt 50 can be considered a "transfer point." Each brush can be accompanied by a manifold such as 20*c*, 20*m*, 20*y*, 20*k*, as well as include any other property or feature as described above for the monochrome case. For each photoreceptor, the intermediate transfer belt 50 acts in the same manner as the sheet S in the FIG. 2 discussion above to receive toner in an imagewise arrangement.

Further with regard to FIG. 4, once a set of primary-color toner layers are built up on the intermediate transfer belt 50 to form a full-color image, a brush such as 30*t* can be used to transfer the toner layers from the belt 50 to a print sheet S at a final transfer point, much in the manner as the sheet in the FIG. 2 discussion above. The brush 30*t* can be accompanied by a manifold 20*t*, and push against a backing roll 40*t*, as well as include any other property or feature as described above for the monochrome case. Although FIG. 4 shows the use of brushes for transfer at each transfer point from the photoreceptors to the intermediate transfer belt and the final transfer point from the intermediate belt to the print sheet, in a practical application the brush arrangement can be provided at one or any of these transfer points.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants, patentees, and others.

The invention claimed is:

1. An electrostatographic printing apparatus, comprising:

a charge receptor;

a cylindrical rotatable brush forming a nip against a portion of the charge receptor, the nip being suitable for passing a sheet therethrough, the brush comprising fibers, each fiber being semi-resistive; and rotating means for causing the brush to rotate, the rotating means causing the brush to be substantially stationary when a sheet is between the brush and the charge receptor.

2. An electrostatographic printing apparatus, comprising:

a charge receptor;

a cylindrical rotatable brush forming a nip against a portion of the charge receptor, the nip being suitable for passing a sheet therethrough, the brush comprising fibers, each fiber being semi-resistive; and rotating means for causing the brush to rotate, the rotating means accelerating the brush as a sheet leaves the nip between the brush and the charge receptor.

3. An electrostatographic printing apparatus, comprising:

a charge receptor;

a brush forming a nip against a portion of the charge receptor, the nip being suitable for passing a sheet therethrough, the brush comprising fibers, each fiber being semi-resistive; and means for drawing a vacuum around a portion of the brush.

4. The apparatus of claim 3, further comprising a manifold disposed around a portion of the brush.

5. The apparatus of claim 4, the manifold defining a plurality of portions, each portion characterized by an air-flow velocity.

6. An electrostatographic printing apparatus, comprising:

a charge receptor;

a brush forming a nip against a portion of the charge receptor, the nip being suitable for passing a sheet therethrough. the brush comprising fibers, each fiber being semi-resistive;

the charge receptor defining a ground plane, the brush being configured relative to the charge receptor to substantially avoid contacting the ground plane.

7. An electrostatographic printing apparatus, comprising a first charge receptor, a rotatable intermediate transfer member receiving marking material from the first charge receptor at a first transfer point;

the rotatable intermediate transfer member transferring marking material to a print sheet at a final transfer point;

at least one of the first transfer point and the final transfer point having associated therewith a brush in contact with the rotatable intermediate transfer member, the brush including fibers, each fiber being semi-resistive, the fibers comprising a non-metallic polymer;

wherein each brush has associated therewith means for drawing a vacuum around a portion of the brush.

* * * * *